United States Patent [19]

Sloop, Sr.

[11] Patent Number: 4,704,881

[45] Date of Patent: Nov. 10, 1987

[54] BARREL LOCK ASSEMBLY

[76] Inventor: Clifford E. Sloop, Sr., P.O. Box 1574, Columbus, Ga. 31902

[21] Appl. No.: 803,561

[22] Filed: Dec. 2, 1985

[51] Int. Cl.[4] ..... B65D 55/14

[52] U.S. Cl. ..... 70/158; 70/34; 70/424; 70/428; 70/430

[58] Field of Search ..... 70/158–173, 70/32, 33, 34, 23, 423, 424, 426, 428, 429, 430

[56] References Cited

U.S. PATENT DOCUMENTS 21,616 9/1858 Moulsa ..... 70/424

881,364 3/1908 Wheeler ..... 70/424

FOREIGN PATENT DOCUMENTS 336919 5/1921 Fed. Rep. of Germany ..... 70/424

*Primary Examiner*—Robert L. Wolfe

*Attorney, Agent, or Firm*—Newton, Hopkins & Ormsby

[57] ABSTRACT

A barrel lock assembly for use in securing a lock housing over the latch or access point of a securable enclosure, such as a utility meter box, is disclosed, having a bar member with a stop on the distal end for engaging a surface on the lock housing or on the enclosure to be secured. A second bar member is disposed parallel to the first and has a head portion which receives the proximal end of the first bar member. The head and the first bar member have axially aligned apertures for receiving a suitable padlock and holding the assembly together.

9 Claims, 11 Drawing Figures

BARREL LOCK ASSEMBLY

BACKGROUND OF THE INVENTION

Utility meter boxes are supplied by the utility companies to their customers and are somewhat standardized in type and appearance. The boxes have a common purpose, that of metering electrical or other usage to determine what is owed to a utility company for the service. When a meter is installed, it is common practice for the installer to attach a locking wire clip or similar device at the latch portion of the meter, which can only be removed by essentially destroying the clip or device. This serves as an indicator for the utility company to determine whether a meter may have been tampered with. A typical indicator is a thin copper wire with a lead clasp. The meter box is closed and the wire is threaded through the latch, whereupon the lead clasp is clamped down on the wire with a plier-like device which stamps the installer's code number in the soft lead. Such a device is little deterrent to a potential tamperer.

A locking device which is currently in wide use is a type of barrel lock. The conventionaly barrel lock is cylindrical with a spring loaded mechanism inside. The mechanism forces a pair of ball bearings outwardly to a position where they exceed the circumference of the cylinder. Upon withdrawing the spring force with a special key; the bearings are released and can be moved inwardly to pass through a lock housing. Once inserted, the spring is released and the barrel lock is secured by the ball bearings. This type of lock is generally quite expensive, as is the key required to open the lock.

Most meter boxes are supplied in one of two general embodiments having distinct methods of access. Some have locking rings securing a translucent globe or cover over the viewing window or socket, while others have a hinged door which is unlocked and opened to gain access to the box. Means designed to secure such boxes, including the barrel lock described above, have, in general, proven too expensive or ineffective.

The theft of services from utility companies is an especially widespread problem. Customers who do not pay for the electrical or other services and have their meter disconnected often break into the meter and reconnect the line. Another common problem involves theft of services by those who break into and adjust their meter downwardly to reflect a lower than actual usage. The utility companies have developed many different devices and methods to try to prevent such occurrences; however, those stealing the service have been equally as inventive.

Since the meters must be accessible to servicemen and other utility company employees in case of problems or breakdown of the meter, they can be opened. Consequently, unauthorized persons have also been able to bypass or defeat current security devices.

This also presents safety problems. For example, the main power lines running into an electrical meter box normally carry relatively high amperage current which is then divided into the multiple lower-amperage circuits which extend throughout the structure. Thus, unauthorized entrants risk severe injury from electrical shock due to lack of safety knowledge and procedures.

SUMMARY OF THE INVENTION

It is, therefore, one of the principal objects of the present invention to provide a barrel lock assembly for utility meter that is accepted by most types of lock housings currently in use on such boxes, and which provides a high degree of security in such installations.

Another object of the present invention is to provide a barrel lock assembly that is easy to use, and which is easily and inexpensively manufactured.

A further object of the present invention is to provide a barrel lock assembly that is durable and provides a long service life.

These and additional objects are attained by the present invention which relates to a barrel lock assembly especially suited for use as a lock for utility meter boxes, although its use may be expanded to other items or devices that have suitable lock housings. The assembly has first and second bar members, one with an abutment means for engaging a lock retaining means, and both having apertures formed therein for receiving a suitable padlock. The other bar member has a generally circular head means which receives the ends of the bar members, keeping them together in combination with the padlock.

The present assembly may be used on a plurality of lock housings, is less expensive than conventional barrel-type locks, and has no internal mechanism susceptible to wearing out. The present barrel lock is normally formed from metal or a relatively strong or dense plastic and is easy for the meter technicians to use.

Various additional objects and advantages will become apparent from the below description, with reference to the accompanying drawings.

DETAILED DESCRIPTION OF THE PREFERRED EMBODIMENT

Figure 1:
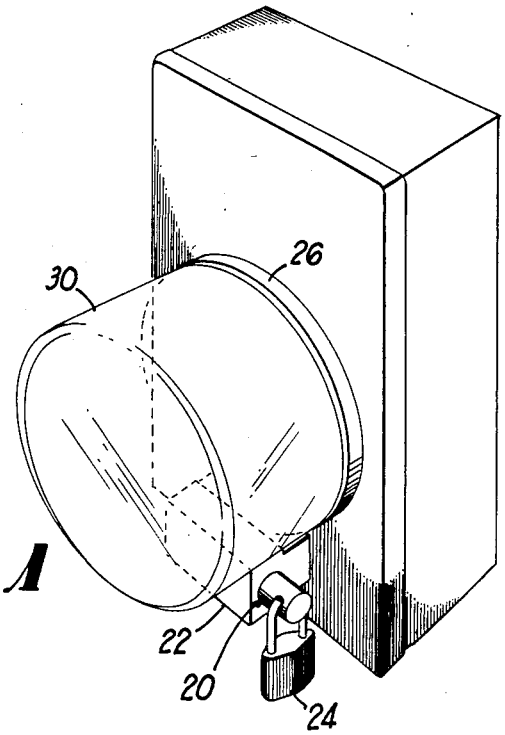
FIG. 1 is a perspective view of a conventional utility meter box, here having the present barrel lock assembly installed thereon in combination with the lock housing.

Referring now more specifically to the drawings, and to FIG. 1 in particular, numeral 20 designates generally the present barrel lock assembly, shown here installed in a type of lock housing 22, and secured with a conventional padlock 24. The purpose of the lock housing and the present barrel lock is to protect the access point, here the point where locking ring 26 is connected by screw 28, from unauthorized entry. As shown in FIG. 1, locking ring 26 is secured around the conventional, translucent globe-type cover 30 which protects the viewing window or socket from the elements or other disturbances. The present barrel lock assembly may be composed of any suitable material, such as steel or plastic, providing durability for a long service life.

As mentioned above, screw 28 and the conventional indicator wire or clip (not shown), do not provide the requisite security. Thus, a lock housing 22 is provided having a bracket member 32 and a cover member 34. The bracket has tabs 36 which receive screw 28 and connect the bracket member to the meter box assembly, and a lock retaining means, such as tab 38, with a lock-receiving aperture 39. The cover member also has a lock retaining means or plate 40 with an aperture 42 formed therein, and an aperture 44 formed in the outer wall for admitting the lock.

Figure 2:
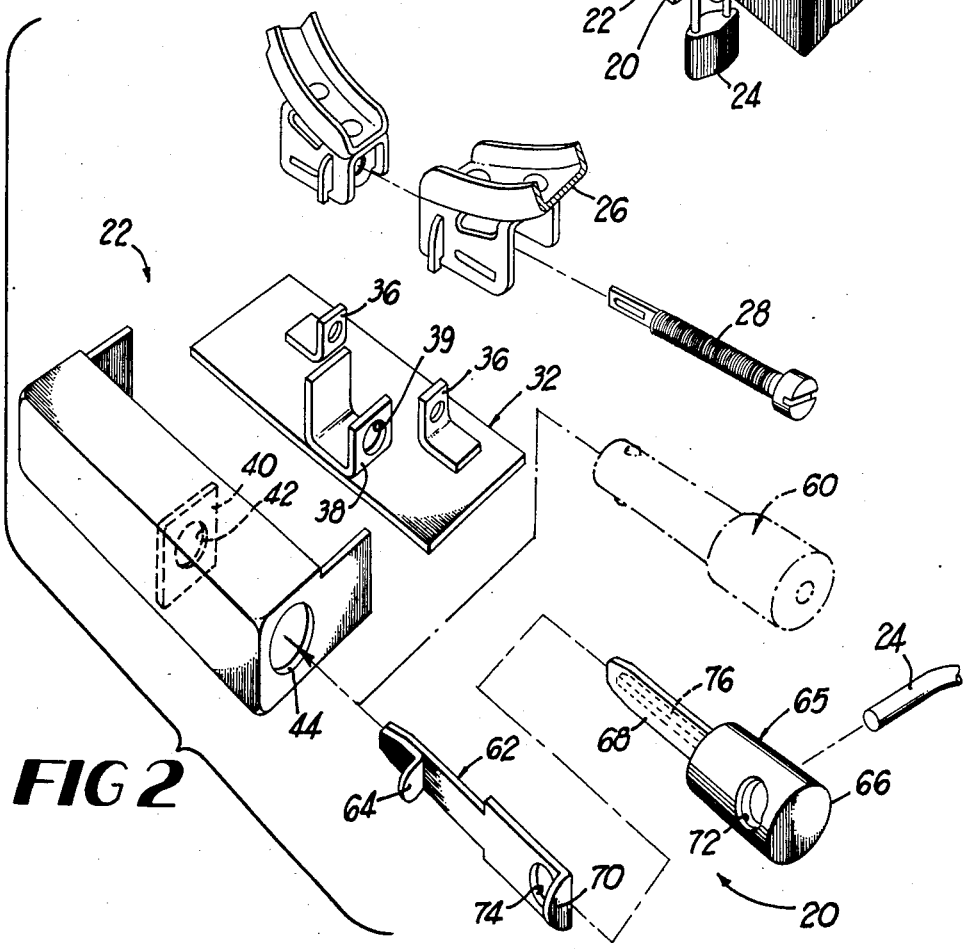
FIG. 2 is an exploded partial perspective view of the present barrel lock assembly and the lock housing shown in the preceding figure.

The lock housing would normally accept a conventional type of barrel lock 60, shown in FIG. 2. As noted above, these locks are expensive, as are the keys which operate locks such as lock 60. The present barrel lock assembly 20 is designed to replace lock 60 at a fraction of the cost and without sacrificing any of the security.

Figure 3:
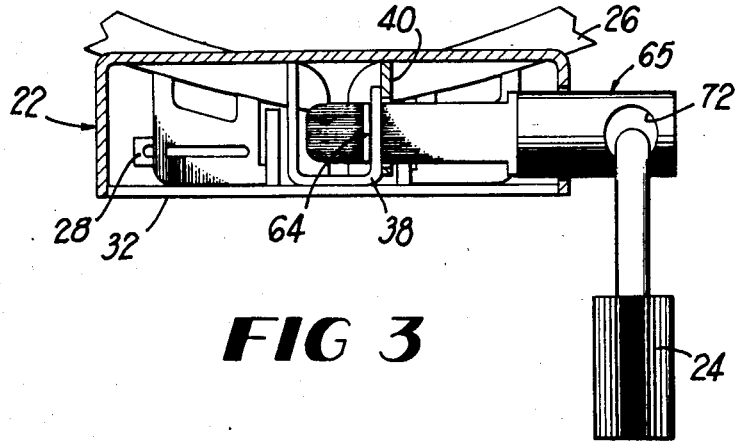
FIG. 3 is a partial side elevational view of the present barrel lock assembly, the housing shown partially in cross section to illustrate the installed position.
Figure 4:
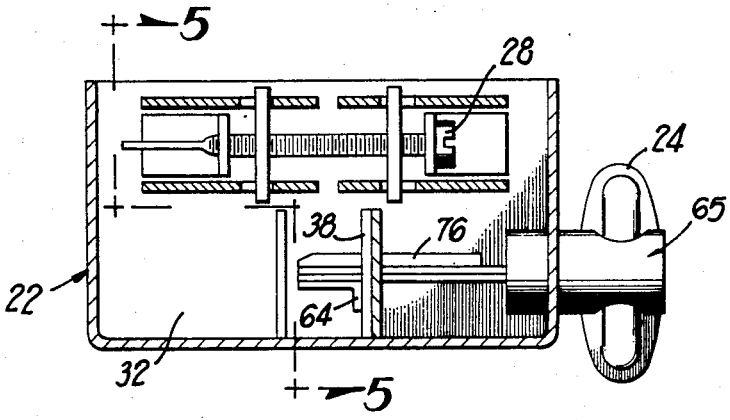
FIG. 4 is a partial, top plan view, similar to the preceding figure, showing the installed position of the barrel lock assembly.
Figure 5:
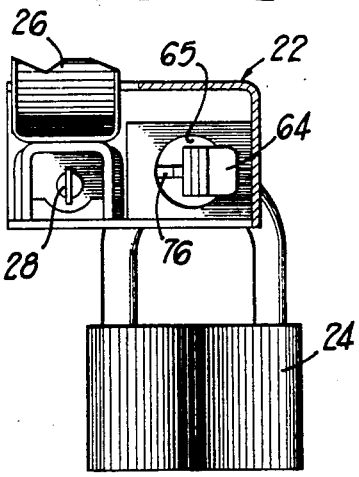
FIG. 5 is a cross sectional view of the present invention in installed position, the section being taken on line 5—5 of FIG. 4.

The present invention has an elongated bar member 62, the distal end of which has a stop means or abutment 64 which may be formed integrally with bar 62 or affixed thereto, as by welding. The bar 62 is inserted into the assembled lock housing, through apertures 44, 42 and 39, as shown in FIGS. 3 through 5. The abutment 64 is maneuvered through the aligned apertures with slight angular or rotative movements until it engages the wall of lock retaining means 38.

Mounted in place adjacent the first bar member is a second bar member 65, having two main components, a head portion 66 and a shank portion 68 which projects axially from the generally hollow, head portion. The cylindrical head accepts the proximal end of bar member 62. Disposed at this proximal end is an abutment 70, which engages the end wall of the head portion upon its insertion therein. Abutment 70 is designed to keep bar 62 disposed adjacent shank 68 when the present invention is assembled, as shown in FIG. 4. This prevents the present lock from working loose after installation.

Both the head portion 66 and bar member 62 have an aperture, 72 and 74, respectfully, for receiving a suitable lock, such as padlock 24. The apertures are in general axial alignment when the present locking assembly is completed and the bar 62 and the shank 68 are disposed adjacent one another. The shank includes brace means 76 secured axially along the outer surface thereof for essentially filling the apertures, thereby preventing angular movements of the assembled lock and keeping abutment 64 engaged with the wall of the tab 38 when the padlock is in place. The present invention is also fully rotatable within the lock housing when installed or during installation, thereby facilitating its installation and use.

Figure 7:
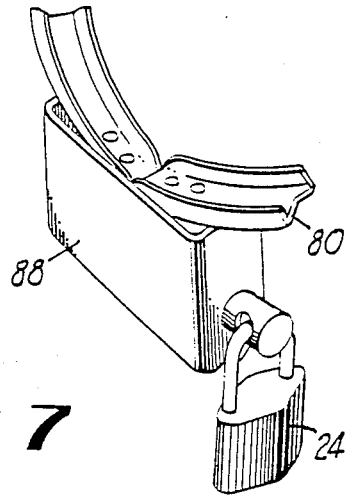
FIG. 7 is a partial perspective view of the present invention, shown in installed position in the lock housing of FIG. 6.
Figure 6:
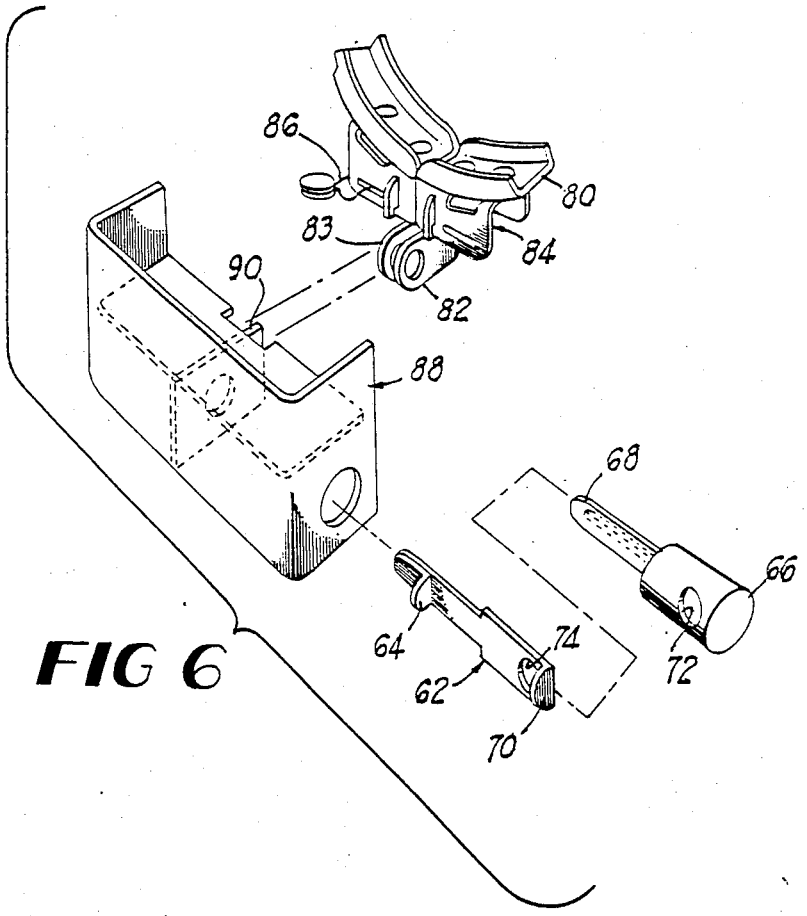
FIG. 6 is an exploded partial perspective view of the present barrel lock assembly in combination with a different type of lock housing.
Figure 8:
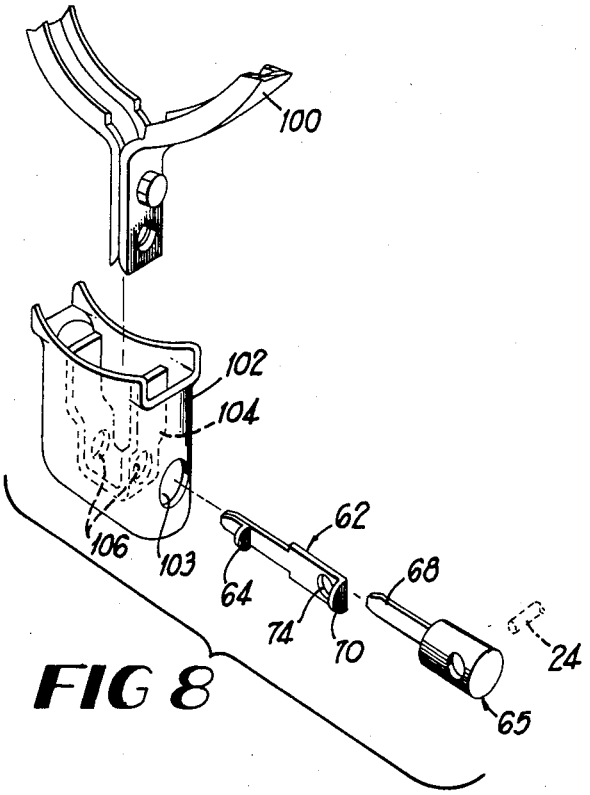
FIG. 8 is an exploded, partial perspective view of the present barrel lock assembly, in combination with another type of lock housing.

FIGS. 6 through 11 illustrate the present barrel lock assembly in use with a plurality of differently configured lock housings. FIGS. 6 and 7 show a lock housing similar to that shown in the preceding figures but designed for a slightly different locking ring. This ring 80 has tabs 82 and 83 descending from the screw housing 84 which normally accept an indicator wire or clip, such as wire 86, or a padlock. To increase security around the screw housing, a lock housing 88 is installed, having a lock retaining means or plate 90 secured therein. The present lock is installed in the same manner as hereinbefore described. Bar member 62 is maneuvered through the apertures in the housing 88, plate 90, and tabs 82 and 83, disposing abutment 64 against the outer side of tab 83.

The shank of the headed bar member is then inserted through the apertures, disposing shank 68 adjacent bar member 62 and head portion 66 over the proximal end with its abutment 70. With apertures 72 and 74 thus aligned, a lock may be inserted therethrough as shown in FIG. 7.

Figure 9:
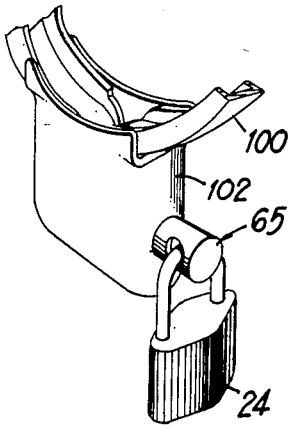
FIG. 9 is a partial, perspective view showing the present barrel lock assembly installed in the housing of FIG. 8.

Two additional lock housings are shown in FIGS. 8 through 11 to further illustrate the utility of the present invention. These housings were originally designed for conventional, barrel-type locks, such as the one shown in FIG. 2. The ring 100 in FIGS. 8 and 9 has the lower ends extended downwardly with apertures formed therein for accepting an indicator wire or lock. To increase security, housing 102, having an aperture 103, is provided to enclose the point of connection where the ends of the ring are secured together. The housing has a lock retaining means 104 formed therein with apertures 106 for receiving and retaining a lock. Installation of the present barrel lock proceeds as discussed hereinabove. The bar member 62 is inserted first, the stop or abutment 64 engaging the wall of the lock retaining means 104, upon passage through apertures 103 and 106. The headed member is inserted next through the apertures, the head 66 enclosing abutment 70. The completed assembly is shown in FIG. 9, the point of connection being securely enclosed to aid in preventing unauthorized tampering with the meter.

Figure 11:
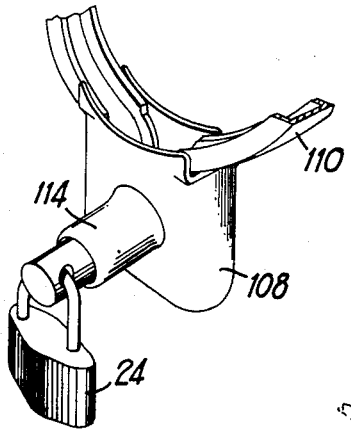
FIG. 11 is a partial perspective view showing the present barrel lock assembly installed in the lock housing shown in the preceding figure.
Figure 10:
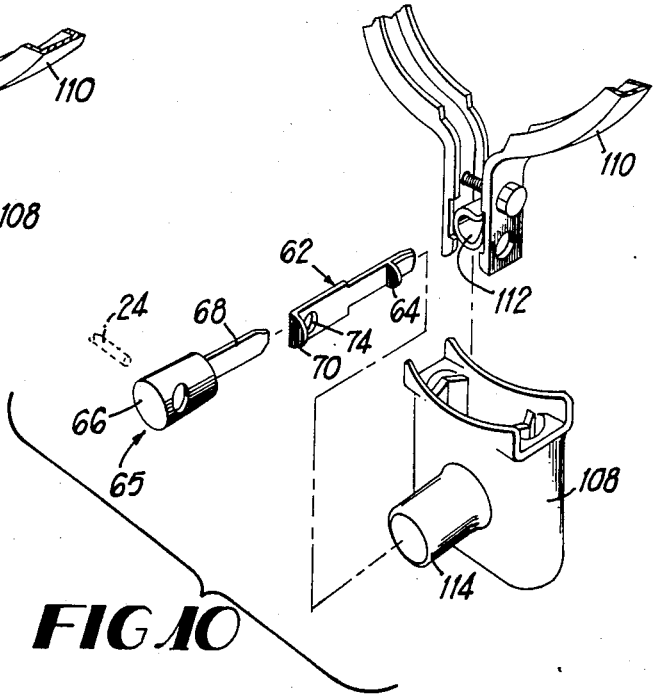
FIG. 10 is an exploded, partial perspective view showing the present barrel lock assembly in combination with still another type of lock housing.

FIGS. 10 and 11 illustrate a similar lock housing 108. The ring 110 has its free ends secured by a bolt, with a small cylindrical member 112 disposed between the ends of the ring. Housing 108 is placed over the connection point and the present barrel lock assembly is inserted through the neck piece 114 formed in the housing and through cylinder 112, the sequence being as described earlier. The completed assembly is shown in FIG. 11.

As in the previously shown figures, the point of connection of the locking ring or the access point or latch for the meter box is shielded by a lock housing and the lock housing is secured in place by the present barrel lock assembly. The assembly is easily installed and removed, the technicians needing only the key or the combination for the padlock which secures the assembly together.

The present barrel lock assembly can be formed from any suitable material, for example, steel or a dense plastic. While the assembly is shown as applicable to utility meter boxes, application may also be had to other securable devices which have a lock housing with lock retaining means formed therein. In addition, while shown as generally cylindrical, the present assembly may also be given other forms, this being dependent on the type and/or shape of the lock housing.

While an embodiment of a barrel lock assembly has been shown and described in detail herein, various changes and modifications may be made without departing from the scope of the present invention.

I claim:

1. A barrel lock assembly for use in combination with a lock retaining means to secure a lock housing at the access point of a utility meter, said housing having an aperture for receiving the assembly, said assembly comprising a first bar member having stop means disposed near the distal end thereof for engaging the lock retaining means, a second bar member disposed generally parallel with said first bar member and having head means at one end thereof with a closed end and an open end for receiving the proximal end of said first bar member, said first bar member and said head means having aligned apertures formed therein for receiving a securing means for keeping said assembly together.

2. A barrel lock assembly as defined in claim 1 in which said second bar member has a shank portion with brace means thereon for keeping said assembly axially aligned with the apertures in the lock housing.

3. A barrel lock assembly as defined in claim 1 in which said first bar member has an abutment means on the proximal end thereof for engaging said head means upon the insertion of said first member therein.

4. A barrel lock assembly as defined in claim 3 in which said abutment means and said stop means project laterally at approximately a ninety degree angle from said first bar member.

5. A barrel lock assembly as defined in claim 1 in which said first bar member has a abutment means on the proximal end thereof for engaging said head means upon the insertion of said first member therein.

6. A barrel lock assembly as defined in claim 5 in which said second bar member has a shank portion with brace means thereon for keeping said assembly axially aligned with the apertures in the lock housing.

7. A barrel lock assembly for insertion into an aperture on a lock housing for keeping the lock housing secured around the latch portion of a securable enclosure, in combination with a lock retaining means and a padlock means, said assembly comprising a first, generally flat bar member, disposed in the aperture and having a distal end with a stop means secured near said distal end for engaging the lock retaining means, a second, generally flat bar member disposed in the aperture generally parallel with said first member and having head means at one end thereof with a closed end and an open end for receiving and enclosing therein the proximal end of said first member, said head means and said first bar member having apertures formed therein for receiving the padlock means.

8. A barrel lock assembly as defined in claim 7 in which said first bar member has an abutment means on the proximal end thereof for engaging said head means upon the insertion of said first member therein.

9. A barrel lock assembly as defined in claim 8 in which said second bar member has a shank portion with brace means thereon for keeping said assembly axially aligned with the apertures in the lock housing.

* * * * *